United States Patent [19]

Kussow

[11] 3,976,273

[45] Aug. 24, 1976

[54] STANCHION WITH MILKING STOOL ATTACHMENT

[76] Inventor: Thomas Kussow, Rte. 1, Little Suamico, Wis. 54141

[22] Filed: Feb. 18, 1975

[21] Appl. No.: 550,721

[52] U.S. Cl. ..... 248/221 R; 119/27

[51] Int. Cl.[2] ..... F16M 13/02

[58] Field of Search ..... 119/27, 14.03; 248/221, 248/230

[56] References Cited

UNITED STATES PATENTS

| | | | |
|---|---|---|---|
| 1,131,540 | 3/1915 | Nerenhausen | 248/221 |
| 1,216,014 | 2/1917 | Thrune | 248/221 |
| 1,236,960 | 8/1917 | McMillan | 248/221 |
| 1,839,313 | 1/1932 | Hibbs et al. | 119/14.03 X |

*Primary Examiner*—Hugh R. Chamblee

*Attorney, Agent, or Firm*—George H. Mitchell, Jr.

[57] ABSTRACT

A milking stool is attached to a stanchion with a collar which loosely encircles the stanchion so that the stool extends horizontally when positioned on the upright portion of the stanchion while allowing the stool to be moved upwardly to be suspended from a horizontal portion of the stanchion when not in use.

6 Claims, 2 Drawing Figures

STANCHION WITH MILKING STOOL ATTACHMENT

This invention relates to animal husbandry, and more particularly to a milking stool for use in barns where cows are assembled side by side in an area to be milked and while in that area are separated from each other by stanchions consisting of heavy metal tubing having an upright portion projecting upwardly from the ground, or barn floor, near the rear of each animal and curving forwardly a few feet from the floor in a horizontal direction to be attached at their other ends to a framework which may also support releasable yokes which encircle the animals' necks while assembled in that area.

Whether the cows are to be milked by hand, or by machine, it is necessary for the person doing the work to spend a certain amount of time at each animal in a seated position. In either case the milker must either carry a milk pail, or milking machine equipment and the necessity for carrying a stool as well makes the operation awkward.

If a milking stool is provided at each stall, so that it does not have to be carried around, a further difficulty arises from the fact that if left on the ground, or floor, it can be misplaced, or kicked over, or damaged by movement of the animals; if not damaged, the seat of the stool may very likely be dirtied.

An object of the present invention is, therefore, to provide a milking stool which will be available for immediate use and yet which can be stowed in a position which is off the floor and out of the way when not in use.

It is also an object of the invention to provide a milking stool which cannot be misplaced and is always in an easily accessible place ready for immediate use.

It is also an object of the invention to provide a milking stool which forms a permanent part of the stanchions which define the stalls into which the cows are led for milking.

Figure 1:
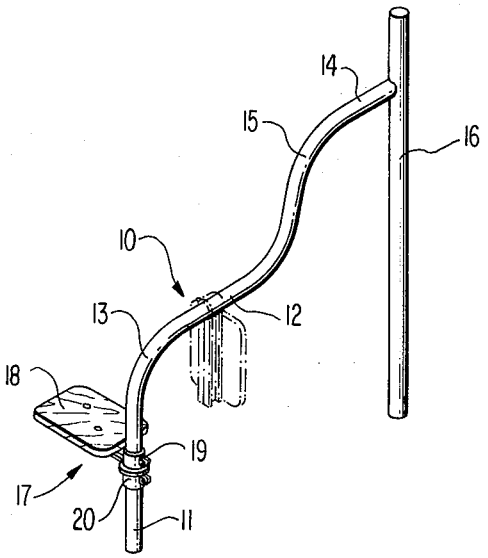
Figure 2:
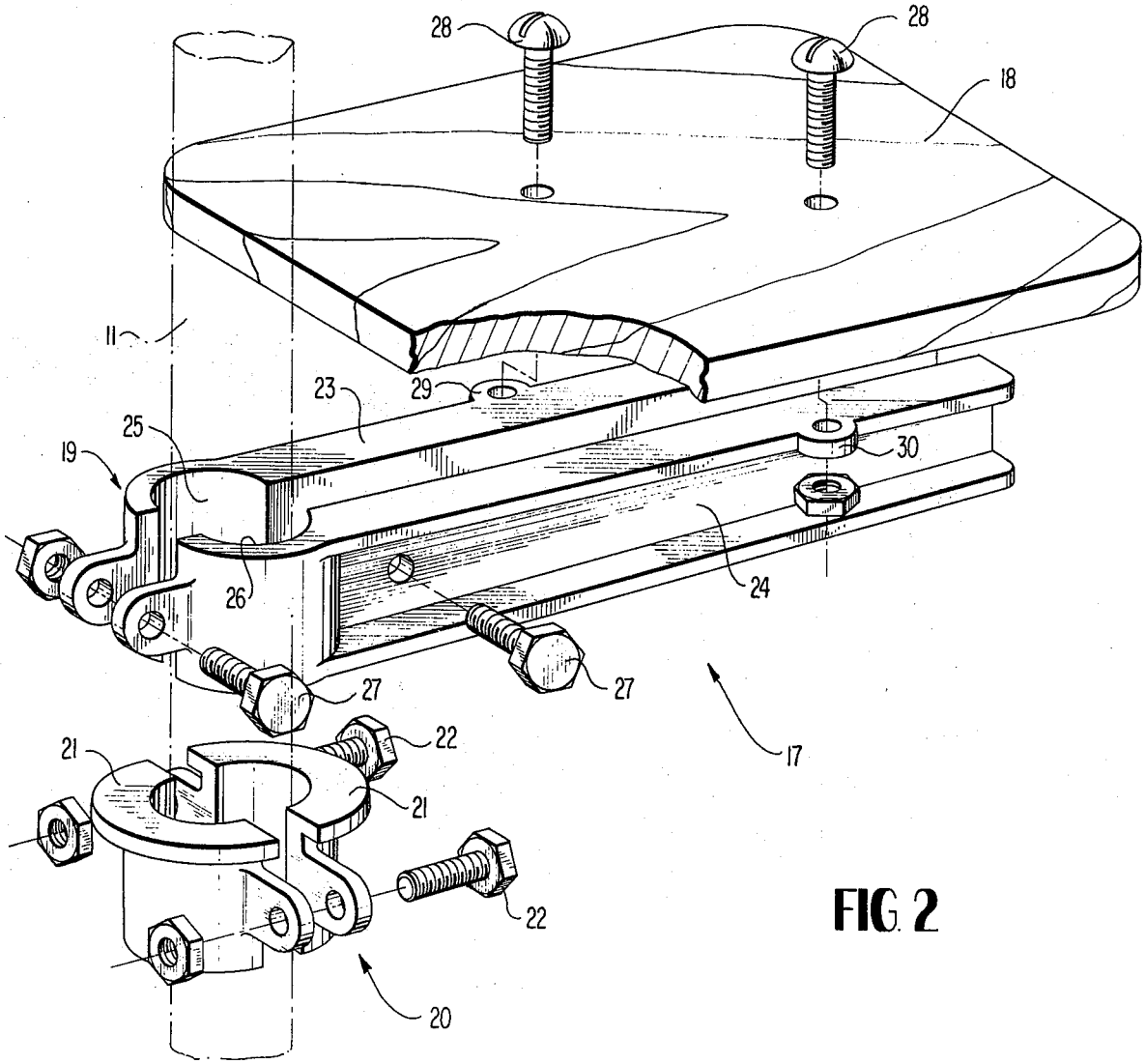

Other objects and advantages will be apparent to those skilled in the art after reading the following specification in connection with the annexed drawings, in which;

FIG. 1 is a perspective view of a preferred form of milking stool constructed in accordance with this invention and FIG. 2 is an exploded view of the various elements comprising the invention.

In the drawings, the numeral 10 indicates generally a stanchion composed preferably of heavy metal tubing which serves to define one side of a stall for a cow to be milked. The stanchion comprises an upright first section 11, one end of which is supported in the ground, or floor of a barn, the upper end being joined to a horizontal second section 12 by an arcuate section 13. The tubing extends forwardly and may include a horizontal third section 14, joined to the second section by another arcuate section 15, the extremity of the tubing being attached to a vertical section 16 of the stall framework.

The milking stool is indicated generally by numeral 17 and may consist of a flat seat 18 of heavy plywood, or similar material, which can be padded if desired. The seat is mounted on an elongated support which includes a portion, indicated by numeral 19, which loosely encircles the tubing comprising the stanchion 10, and permits the seat to revolve around the axis of the tubing to any position, while at the same time holding the seat in a horizontal plane when the collar encircles the upright section 11 of the tubing.

A stop means, indicated generally by numeral 20, is also provided on the stanchion to position the seat at the desired level. While the stop means could consist of a bar, or bolt, extending horizontally through the stanchion, it is preferably to provide a split collar, having two mating semi-circular portions 21 which can be clamped together tightly against the tubing 11 by bolts 22. This arrangement also permits the height of the seat to be adjusted, and does not require any modification of the already installed tubing.

The support for the seat 18 preferably consists of a pair of elongated complementary members 23 and 24, each of which is formed, either by casting or stamping, with respective mating oppositely directed semi-cylindrical recessed portions 25 and 26 at one end, so that when the two elongated members are placed in abutting engagement with each other and secured as by means of bolts 27 the recesses 25 and 26 define the collar 19, the radius of curvature of the recesses being such that the collar will revolve easily around the tubing while maintaining the horizontal position of the seat. The seat 18 is secured to the support members by bolts, or screws, 28 which pass through openings provided in the lateral lugs 29 and 30 on the respective support members. These fasteners, in addition to holding the seat in place, also assist in holding the two support members together at locations remote from the collar 19.

The inside diameter of the collar 19 should also be large enough to allow the entire seat assembly to be lifted upwardly along the upright portion 11 and the curved portion 13 to a position along the horizontal section 12 of the tubing, where the seat may be suspended when not in use. In this position it is well clear of the floor and does not cause any obstruction to movement of the animals or attendants going through the stalls alongside the animals, because the seat will swing out of the way and return to a suspended position automatically. Obviously, if the stanchion is of the type which includes a second horizontal section 14, the seat can alternatively be stowed, when not in use, on that section.

What is claimed is:

1. In a stowable seat, the combination including a stanchion, a seat member and support means connecting said seat member and said stanchion for freely revolvable and axially slidable movement of the seat member with respect to the axis of the stanchion while maintaining said member in a plane normal to said axis, said support means comprising a pair of elongated complementary elements, each having a semi-cylindrical recess, said recesses defining a collar at one side of said seat closely encircling said stanchion when said elements are assembled in complementary relationship, said elements being provided with complementary bore holes adjacent said recesses to receive at least one fastening element for joining the elements together, the respective elements each having another opening spaced from the bore hole and extending at right angles thereto for receiving fastening means to attach said seat member to the respective elements, said stanchion having a first section having an axis extending in a direction to position the seat member in horizontal planes and a second section having an axis angularly related to the axis of the first section for suspending the seat member in a stowed position.

2. The invention described in claim 1 wherein said openings for attaching the seat member are also longitudinally spaced from each other.

3. The invention described in claim 1 wherein the first section of said stanchion also includes stop means for limiting downward movement of said support means.

4. The invention described in claim 3 wherein said stop means comprises a closed fitting split collar, and means for clamping said collar on said stanchion at a plurality of locations.

5. The invention described in claim 1 wherein said first and second sections of said stanchion are joined by an arcuate section permitting movement of said support means between said sections and stop means included in said first section for limiting downward movement of said support means.

6. The invention described in claim 5 wherein said first section of the stanchion is generally vertical, the second section being generally horizontal, said stanchion also including a third horizontal section joined to said second section by another arcuate section.

* * * * *